US007882716B2

(12) United States Patent
Noro et al.

(10) Patent No.: US 7,882,716 B2
(45) Date of Patent: Feb. 8, 2011

(54) DRY-CLEANING MACHINE

(75) Inventors: Masaru Noro, Osaka (JP); Kenji Mitsunari, Osaka (JP); Koichi Hatsuda, Osaka (JP); Katsuhito Nakagawa, Osaka (JP); Shigeru Yamao, Osaka (JP)

(73) Assignee: Sanyo Electric Co., Ltd., Moriguchi, Osaka (JP)

( * ) Notice: Subject to any disclaimer, the term of this patent is extended or adjusted under 35 U.S.C. 154(b) by 495 days.

(21) Appl. No.: 11/816,482

(22) PCT Filed: Jan. 31, 2006

(86) PCT No.: PCT/JP2006/301506

§ 371 (c)(1),
(2), (4) Date: Aug. 16, 2007

(87) PCT Pub. No.: WO2006/087899

PCT Pub. Date: Aug. 24, 2006

(65) Prior Publication Data

US 2009/0049872 A1 Feb. 26, 2009

(30) Foreign Application Priority Data

Feb. 16, 2005 (JP) ..... 2005-038945
Mar. 15, 2005 (JP) ..... 2005-073638

(51) Int. Cl.
*D06B 9/06* (2006.01)

(52) U.S. Cl. ..... 68/18 C; 68/18 R

(58) Field of Classification Search ..... 68/18 C, 68/18 R

See application file for complete search history.

(56) References Cited

U.S. PATENT DOCUMENTS 1,354,483 A * 10/1920 Holland ..... 96/390

(Continued)

FOREIGN PATENT DOCUMENTS

DE 4220072 A1 12/1993

(Continued)

OTHER PUBLICATIONS

Supplementary European Search Report dated Feb. 12, 2008, issued in corresponding European Patent No. 06712649.

(Continued)

*Primary Examiner*—Frankie L Stinson
(74) *Attorney, Agent, or Firm*—Westerman, Hattori, Daniels & Adrian, LLP

(57) ABSTRACT

A vaporized solvent emitted from the laundry in the drum during the drying process is condensed within an air passage. From this passage a liquid mixture (solvent and water) is guided to a first liquid storage tank 50 through a liquid mixture line 51. An air relief pipe 52 is connected to an intermediate point of this line so that air coming from the air passage is released through an activated carbon filter 53 to the outside. The outlet end 51*a* of the liquid mixture line 51 is immersed in the solvent in the upper layer within the first liquid storage tank 50. Due to the hydraulic pressure acting on the outlet end 51*a*, the air tends to flow toward the air relief pipe 5. This reduces the current pressure of the air coming from the air passage and alleviates its influence within the first liquid storage tank 50, so that a vertical motion of the interface between the solvent and water due to the current pressure is suppressed. Thus, unwanted matter gathering around the interface is prevented from sticking to a filter, and the solvent is prevented from being discharged.

5 Claims, 7 Drawing Sheets

U.S. PATENT DOCUMENTS

| | | | | | |
|---|---|---|---|---|---|
| 1,902,538 | A | * | 3/1933 | Brace et al. | 202/177 |
| 2,080,737 | A | * | 5/1937 | Nutt et al. | 208/229 |
| 2,176,705 | A | * | 10/1939 | Derby | 8/139.1 |
| 2,316,669 | A | * | 4/1943 | Busi | 68/20 |
| 2,467,435 | A | * | 4/1949 | Langhurst | 202/173 |
| 3,206,950 | A | * | 9/1965 | Xeros | 68/12.09 |
| 3,234,660 | A | * | 2/1966 | Williams et al. | 34/527 |
| 3,254,513 | A | * | 6/1966 | Gosnell | 68/12.08 |
| 4,074,984 | A | * | 2/1978 | Fuhring | 96/114 |
| 5,391,361 | A | * | 2/1995 | Thakur et al. | 422/295 |
| 5,431,827 | A | * | 7/1995 | Tatch | 210/767 |
| 6,004,403 | A | | 12/1999 | Gray et al. | |
| 6,059,845 | A | * | 5/2000 | Berndt et al. | 8/142 |
| 6,086,635 | A | * | 7/2000 | Berndt et al. | 8/142 |
| 2004/0065125 | A1 | | 4/2004 | Asada et al. | |

FOREIGN PATENT DOCUMENTS

| | | | | |
|---|---|---|---|---|
| JP | 63-156508 | A | | 6/1988 |
| JP | 64-025899 | | * | 1/1989 |
| JP | 64-52512 | U | | 3/1989 |
| JP | 2297398 | A | | 12/1990 |
| JP | 7289788 | A | | 11/1995 |
| JP | 833793 | A | | 2/1996 |
| JP | 2001-300206 | A | | 10/2001 |
| JP | 2003511579 | A | | 3/2003 |
| JP | 2003-340215 | A | | 12/2003 |
| JP | 2004121644 | A | | 4/2004 |
| WO | WO 01/27380 | A1 | | 4/2001 |

OTHER PUBLICATIONS

International Search Report of PCT/JP2006/301506, date of mailing May 2, 2006.

Taiwanese Office Action dated May 20, 2010, issued in corresponding Taiwanese Patent Application No. 95104185.

Japanese Office Action dated Aug. 10, 2010, issued in corresponding Japanese Patent Application No. 2005-073638.

* cited by examiner

DRY-CLEANING MACHINE

TECHNICAL FIELD

The present invention relates to a dry-cleaning machine that cleans laundry with a solvent and then dries the cleaned items. More specifically, it relates to a technique for recovering the solvent with high purity by separating water from a water-containing solvent extracted from a distiller which purifies a tainted solvent resulting from the cleaning process, or a water-containing solvent condensed and recovered in a liquid form during the drying process.

BACKGROUND ART

In dry cleaning, a solvent absorbed in laundry during a cleaning process is removed by a drying process, and the solvent thereby vaporized is condensed and recovered in a liquid form. The condensed solvent obtained in this drying and recovering process contains water, which was originally retained in the laundry. This water needs to be separated from the solvent to recover a high-purity solvent free from the liquid. Such a process is also necessary if the dry-cleaning machine includes a distiller, such as the one disclosed in Patent Document 1, which is used to recycle the solvent that has been tainted during the laundry-cleaning process. The solvent collected from such a distiller also contains water, which must be separated from the solvent to recover a high-purity solvent. For this purpose, conventional dry-cleaning machines include a water separator. If the solvent is a commonly used conventional petroleum solvent, it is relatively easy to separate water from the solvent by a so-called relative density difference separation method, because there is a large difference between the relative density of water, which is 1, and that of the solvent, whose density is approximately 0.8.

In recent years, petroleum solvents used thus far are being replaced with silicone solvents because the latter is less harmful to the environment, the health of the dry-cleaning workers, and to the health of the owners of the cleaned laundry, who may suffer from a solvent remaining in the cleaned articles. The relative densities of silicone solvents are approximately 0.95 for cyclic silicone solvents and approximately 0.85 for straight-chain silicone solvents. Thus, the difference in relative density between the silicone solvents and water is smaller than that between the petroleum solvents and water. Though the silicone solvents can also be separated by the aforementioned separation method utilizing the difference in relative density, the separation process requires a longer period of time thus making the process difficult to be coordinated with the drying cycle of the machine. Accordingly, there is a demand for a new type of water separator capable of separating water from a silicone solvent whose relative density differs slightly from that of water while maintaining good coordination with the cyclic operation of the machine.

For solving this problem, the applicant has proposed a water separator, as disclosed in Patent Document 2. FIG. 7 is a schematic sectional view of this conventional water separator. This water separator uses a so-called coalescer-type liquid-liquid separation filter.

As shown in FIG. 7, the water separator includes a liquid storage tank 50 for holding a mixture of water and a condensed solvent, a substantially S-shaped drainage pipe 54 connected to the bottom of the tank 50, and an air pipe 55 connecting the horizontal section 54*b* of the drainage pipe 54 and the top of the tank 50. The liquid storage tank 50 contains a cylindrical filter 58 consisting of a micro-fiber non-woven fabric held by a holder 59. Inside this filter, a solvent recovery pipe 60 penetrating through the bottom of the tank 50 has its upper end port 60*a* open in the upper direction.

During the drying and recovering operation, warm air is emitted from the drum with a vaporized solvent and steam, and this air is rapidly cooled by a cooler to condense the vaporized solvent and steam into a liquid mixture, i.e. a solvent in which water is mixed. The liquid mixture flows through a liquid mixture line 51 into the tank 50 and is collected. The solvent contained in the liquid mixture passes through the fiber mesh of the filter 58, whereas the water is trapped onto the fiber surface and condensed into large drops of water. Then, due to their weight (or relative density difference from that of the solvent), the drops of water settle and gather at the bottom of the tank 50. With the increase in the level of the liquid mixture (or the level of the low-purity solvent in the upper layer), the solvent level within the filter chamber surrounded by the filter 58 also increases. The solvent will then reach the upper end port 60*a*, flow into the solvent recovery pipe 60 and is extracted from the water separator.

Meanwhile, the water collected in the lower layer of the tank 50 is pushed up into the vertical section 54*a* of the drainage pipe 54. The water level is constantly lower by L than the level of the solvent in the upper layer, due to the difference in relative density between the water and the solvent. With an increase in the solvent level within the upper layer of the tank 50, the water level within the vertical section 54*a* of the drainage pipe 54 also increases. The water will finally reach the horizontal section 54*b* of the drainage pipe 54 and flow to the outside.

Thus, the water flows out from the drainage pipe 54, while the solvent returns through the solvent recovery pipe 60 to a liquid supply tank. Normally, the rate of separating the two liquids by the filter 58 is adequately higher than the inlet velocity of the liquid mixture. Therefore, the water and the solvent are surely separated according to the inflow of the liquid mixture, so that the tank 50 will not be filled. The air pipe 55 prevents the water from being siphoned through the drainage pipe 54. If the water level in the drainage pipe 54 falls below the horizontal section 54*b* according to a decrease in the level of the solvent in the upper layer of the tank 50, the water flow through the drainage pipe 54 will immediately stop.

Silicone solvents are water-repellent and do not mix with water. Therefore, it is basically possible to separate water from the silicone solvent by the previously described device. However, the aforementioned conventional water separator has the following problem:

During the drying and recovering operation, a fan is activated to forcefully produce a circulation of air through a passage consisting of the drum, the heater for heating the air, the cooler for condensing the solvent, and other structural elements. Normally, its wind pressure is so high as to cause highly pressurized air to flow into the liquid mixture line 51 along with the liquid mixture. This air flows into the tank 50 and increases the pressure within the top space of the tank 50. As shown in FIG. 7, within the tank 50, the low-purity solvent having a relatively high water content is located over the water, with an interface separating the two liquids. If the aforementioned high-pressure current of air rushes into the tank 50, the wind pressure pushes the liquid surface and lowers the aforementioned interface. The wind pressure is significantly machine-specific since it greatly depends on the air-tightness of the air-circulation passage during the drying and recovering operation. It may also vary according to the amount and/or stirred state of the laundry contained in the drum. Therefore, in the conventional dry-cleaning machine, the interface between the solvent and water within the tank 50 is unstable and makes a vertical motion with a considerable magnitude.

This vertical motion of the interface causes the following problem: During the cleaning process, if dust, fine lint and other unwanted matter come off the laundry and are collected with the solvent, much of this matter gather around the interface due to their relative densities. If the interface rises to a level as high as the filter 58, the unwanted matter gathering around the interface will stick to the filter 58, clogging its mesh and thereby impeding the solvent from passing through it. In the worst case, the rate of separating the two liquids by the filter 58 will be lower than the inlet velocity of the liquid mixture flowing into the tank 50. In this case, the tank 50 will be overfilled or, minimally, the user will need to clean or replace the filter 58 more frequently. Furthermore, in the aforementioned situation, the liquid pressure on the filter 58 can be so high as to help the water pass through the filter 58 with the solvent. If this occurs, the recovered solvent will contain the water and be unusable.

If the interface comes to too low a level, the solvent will flow through the drainage pipe 54 to the outside. Silicone solvents are far more expensive than petroleum solvents. Therefore, allowing this outflow of the silicone solvent will increase the running costs of the dry-cleaning machine. Moreover, the unwanted matter present around the interface can clog the drainage pipe 54, impede or, in the worst case, completely stop the water drainage. If this occurs, the tank 50 will be filled, allowing the overflow of the liquids from the tank 50 or the mixture of water into the solvent, as in the case of the clogging of the filter 58.

In some cases, particularly if the silicone solvent is used, the solvent collected through the solvent recovery pipe 60 by the previous dry-cleaning machine may contain a considerably high percentage of water. The reason is as follows:

When the vaporized solvent contained in the air emitted from the drum is cooled and condensed into a liquid form, the water mixed in the solvent normally turns into large particles, i.e. water drops. However, occasionally, colloidal particles consisting of fine water particles covered with the solvent may be formed. Particularly, silicone solvents are easier to form such colloidal particles; the liquid mixture of the solvent and water recovered from the drying air passage often takes the form of an emulsion in which a large number of colloidal particles are dispersed. Similarly, the solvent distiller vaporizes the solvent by heating and then condenses it into a liquid form by cooling. Therefore, the solvent taken out from the distiller often takes the form of an emulsion in which water is dispersed in the form of colloidal particles.

The colloidal particles have various diameters. Large particles will be stopped by the filter 58 and finally separated by the relative density separation method. However, there are many fine colloidal particles whose diameter is as small as 1 μm. These fine colloidal particles can easily pass through the mesh of the filter 58, so that the silicone solvent thereby recovered will have water mixed in it.

The water-containing solvent thus recovered can cause various problems: Using this solvent in the next cleaning cycle may cause shrinkage of the laundry articles or damage their fabrics. The laundry articles may be harder to dry and easier to gather mold due to inadequate dryness while they are stored. The solvent itself can also suffer from growth of bacteria and give off a smelly stench. Such a solvent is no longer usable for cleaning and must be disposed of. As pointed out earlier, silicone solvents are considerably expensive compared to petroleum solvents. If they cannot be recycled, cleaning will be very costly.

[Patent Document 1] Japanese Unexamined Patent Application Publication No. H07-289788

[Patent Document 2] Japanese Unexamined Patent Application Publication No. 2004-121644

DISCLOSURE OF THE INVENTION

Problem to be Solved by the Invention

The present invention has been devised in view of the problems described thus far. Its first objective is to provide a dry-cleaning machine capable of preventing clogging of the filter and flow-out of the solvent, both of which impede efficient recovery of a high-purity solvent. This objective can be accomplished by restraining the interface between the solvent and water due to their relative density difference, from making an undesirable motion under wind pressure.

The second objective of the present invention is to provide a dry-cleaning machine capable of rapidly separating water from the solvent and efficiently recovering the solvent with high purity level even if the solvent is a silicone solvent or similar solvent whose relative density is close to that of water and hence the water cannot easily be separated only by relative density difference separation.

The third objective of the present invention is to provide a dry-cleaning machine capable of rapidly separating water from the solvent and efficiently recovering the solvent high purity even if the solvent is a silicone solvent or similar solvent whose relative density is close to that of water and which is easy to turn into an emulsion.

Means for Solving the Problems

To accomplish those objectives, the first aspect of the present invention provides a dry-cleaning machine including:

a drying tub for containing laundry that have been cleaned with a solvent;

an air passage for sending air into the drying tub and extracting the air from the drying tub;

a blower for producing an air current through the air passage in a predetermined direction;

a cooler, located in the air passage, for condensing the vaporized solvent contained in the air emitted from the drying tub;

a heater, located in the air passage, for heating the air being sent into the drying tub; and a water separator for separating water from a liquid mixture composed of water and the solvent condensed by the cooler and for recovering the solvent, where the water separator includes a liquid storage tank for temporarily storing the liquid mixture extracted from the air passage, and an air relief section is located in a liquid mixture line for guiding the liquid mixture from the air passage to the liquid storage tank.

In the dry-cleaning machine according to the first aspect of the present invention, the blower produces an air current through the air passage during the drying and recovering operation. The air current is heated by the heater and sent into the drying tub, whereby the solvent retained in the laundry articles is vaporized. This vaporized solvent is then emitted from the drying tub with the air and reaches the cooler, where the vaporized solvent and water are condensed into a liquid form. This liquid mixture flows from the air passage into the liquid mixture line. Along with the liquid mixture, the high-pressure air produced by the blower also enters the liquid mixture line. While the liquid mixture can flow along the wall of the liquid mixture line and reach the liquid storage tank, the majority of air is released to the outside of the machine through the air relief section located in the liquid mixture line. The amount of air that can enter the top space of the liquid storage tank is small, so that the air scarcely affects the liquid level within the liquid storage tank.

Thus, the interface between the water and solvent is stabilized in the liquid mixture stored in the liquid storage tank, where the solvent is located over the water due to the difference in relative density between the water and the solvent. Therefore, even if the tank has a drainage pipe connected to its bottom, the solvent will never flow out through the drainage pipe because the interface cannot come to such a low level. Also, unwanted matter gathering around the interface will be prevented from entering and clogging the drainage pipe. In the case where the tank has a liquid-liquid separation filter immersed in the solvent in the upper layer, the filter will not be clogged by unwanted matter gathering around the interface since the interface cannot come to such a high level.

Basically, the air flowing from the air passage into the liquid mixture line is free from the vaporized solvent since the air is cooled beforehand by the cooler so that the vaporized solvent is condensed into a liquid form. However, it is still possible that a small amount of solvent remains in that air. Accordingly, the air relief section may preferably include a filter for capturing the vaporized solvent when the air is exhausted from the liquid mixture line. This construction is preferable if the air passing through the air relief section is to be released indoors or if the air is released outdoors but the concentration of the vaporized solvent should be suppressed to the lowest possible level. An example of the filter is an activated carbon filter. The present construction removes the vaporized solvent when the air is released through the air relief section to the outside of the machine, thereby reducing negative influences on the ambient environment.

In the dry-cleaning machine according to the first aspect of the present invention, it is preferable that the outlet end of the liquid mixture line be immersed in the solvent located over the water due to the difference in relative density between the water and the solvent in the liquid mixture stored in the liquid storage tank.

In this case, the outlet end of the liquid mixture line receives hydraulic pressure, which depends on the depth under the solvent surface. Therefore, the air is easier to flow toward the air relief section, whose flow resistance is relatively low. Thus, the amount of air attempting to flow into the liquid storage tank is further reduced, whereby not only the level of the liquid mixture within the tank but also the interface between the solvent and water are more stabilized.

In a specific mode of the previously described construction, the water separator includes:

a solvent recovery pipe with a solvent outlet located at its upper end for extracting the solvent located over the water due to the difference in relative density between the solvent and the water in the liquid mixture stored in the liquid storage tank; and a drainage pipe having a vertical section, connected to the lower portion of the liquid storage tank, for guiding the water to a level higher than the connection point, and a bent section, which is located at a downstream position away from the vertical section and whose highest portion is located at a level equal to or appropriately lower than the solvent outlet of the solvent recovery pipe, and the outlet end of the liquid mixture line is located at a level lower than the highest portion of the bent section of the drainage pipe.

In this construction, as the liquid mixture flows into the liquid storage tank, the liquid level within the tank rises and, accordingly, the water level within the vertical section of the drainage pipe also rises. Upon reaching the bent section, the water begins to flow to the outside. Meanwhile, when the solvent in the upper layer of the liquid mixture has risen to the aforementioned level or somewhat higher, the portion of the solvent that has exceeded the solvent outlet begins to flow through the solvent recovery pipe to the outside of the liquid storage tank. As a result, the outlet end of the liquid mixture line is constantly immersed in the solvent, whereby the aforementioned effect of preventing the air inflow by hydraulic pressure is assuredly obtained.

In a preferable mode of the dry-cleaning machine according to the first aspect of the present invention, the previous liquid storage tank is called the first liquid storage tank, and the water separator further includes:

a solvent collection pipe having a solvent outlet at its upper end for extracting a low-purity solvent located above the water due to the difference in relative density between the solvent and the water in the liquid mixture stored in the first liquid storage tank;

a first drainage pipe for discharging the water located under the solvent in the liquid mixture stored in the first liquid storage tank;

a second liquid storage tank for temporarily storing the low-purity solvent extracted through the solvent collection pipe;

a filter chamber forming a high-purity solvent storage section separated from the low-purity solvent by a solvent selection filter immersed in the low-purity solvent stored in the second liquid storage tank, the filter selectively allowing only the solvent to permeate through it from the low-purity solvent side;

a solvent recovery pipe for extracting the high-purity solvent from the high-purity solvent storage section; and a second drainage pipe for discharging the water located in the lower layer of the second liquid storage tank.

In this construction, the first liquid storage tank does not contain a coalescer-type liquid-liquid separation filter; it functions as a simple water/solvent separator using a relative density difference separation method. If the solvent is a silicone solvent or similar solvent whose relative density is close to that of water, the solvent cannot be completely separated from the water by the relative density difference separation; a low-purity solvent, i.e. a solvent having a relatively low purity in which water is mixed, will come to the upper layer. The low-purity solvent is introduced through the solvent collection pipe into the second liquid storage chamber. The second storage chamber includes a filter chamber functioning as the liquid-liquid separation filter. When the low-concentration solvent is at a level where the solvent selection filter is immersed in the liquid, the solvent passes through the filter mesh, whereas the water is condensed into large drops on the filter surface due to the difference in surface tension and other properties. Then, due to the difference in relative density, the drops of water settle and gather at the bottom of the tank. The water collected at the bottom of the second liquid storage tank flows through the second drainage pipe to the outside of the second liquid storage tank. Meanwhile, with the increase in the level of the low-concentration solvent, and the liquid level within the high-purity solvent storage section also increases. This solvent will be extracted through the solvent recovery pipe to the outside of the second liquid storage tank. Thus, it is possible to quickly separate the water and the solvent having a relative density close to that of water, which is typically a silicone solvent, and extract the two liquids.

In this construction, the liquid-liquid separation filter is located outside the first liquid storage tank in which the interface between the (low-purity) solvent and the water may move vertically due to wind pressure or other factors. This design eliminates the possibility that the filter becomes stained with unwanted matter gathering around the interface. Therefore, the frequency of cleaning or exchanging the filter can be lowered. Thus, the user's workload will be lightened and the running costs will be reduced.

The dual-tank liquid-storage system can be applied to not only the water separator in the first aspect of the present invention but also other water separators that are not limited by the characteristic constructions of the first aspect of the present invention.

Accordingly, the second aspect of the present invention provides a dry-cleaning machine including:

a drying tub for containing laundry that have been cleaned with a solvent;

an air passage for sending air into the drying tub and extracting the air from the drying tub;

a blower for producing an air current through the air passage in a predetermined direction;

a cooler, located in the air passage, for condensing the vaporized solvent contained in the air emitted from the drying tub;

a heater, located in the air passage, for heating the air being sent into the drying tub; and a water separator for separating water from a liquid mixture composed of water and the solvent condensed by the cooler and for recovering the solvent, where the water separator includes:

a first liquid storage tank for temporarily storing the liquid mixture extracted from the air passage;

a solvent collection pipe having a solvent outlet at its upper end for extracting a low-purity solvent located above the water due to the difference in relative density between the solvent and the water in the liquid mixture stored in the first liquid storage tank;

a first drainage pipe for discharging the water located under the solvent in the liquid mixture stored in the first liquid storage tank;

a second liquid storage tank for temporarily storing the low-purity solvent extracted through the solvent collection pipe;

a filter chamber forming a high-purity solvent storage section separated from the low-purity solvent by a solvent selection filter immersed in the low-purity solvent stored in the second liquid storage tank, the filter selectively allowing only the solvent to permeate through it from the low-purity solvent side;

a solvent recovery pipe for extracting the high-purity solvent from the high-purity solvent storage section; and a second drainage pipe for discharging the water located in the lower layer of the second liquid storage tank.

Similar to the dry-cleaning machine according to the first aspect of the present invention, in the dry-cleaning machine according to the second aspect of the present invention, the liquid-liquid separation filter is located outside the first liquid storage tank in which the interface between the (low-purity) solvent and the water may move vertically due to wind pressure or other factors. This design eliminates the possibility that the filter becomes stained with unwanted matter gathering around the interface. Therefore, the frequency of cleaning or exchanging the filter can be lowered. Thus, the user's workload will be lightened and the running costs will be reduced.

The water separator having the construction described thus far is also effective in separating water from a petroleum solvent. However, if the difference in relative density between the solvent and water is large, it is less necessary to use a coalescer-type liquid-liquid separation filter. The present invention is particularly advantageous if it is applied to a dry-cleaning machine using a silicone solvent or similar solvent whose relative density is close to that of water.

The third aspect of the present invention provides a dry-cleaning machine including:

a water separator for receiving a water-containing solvent extracted from a distiller for purifying a tainted solvent resulting from a cleaning process and/or a water-containing solvent obtained by cooling and condensing a vaporized solvent emitted from the laundry in order to recover the solvent during a drying process, and for removing the water to recover the solvent, and the water separator includes:

a liquid storage tank for storing the water-containing solvent; and a coarse particle maker for turning colloidal particles of water contained in the solvent stored in the liquid storage tank into coarse particles in order to help the water settle due to the difference in relative density between the solvent and the water.

In the dry-cleaning machine according to the third aspect of the present invention, if the solvent resulting from condensation is in the form of an emulsion in which colloidal particles of water are dispersed, the coarse particle maker helps the fine colloidal particles to turn into coarse particles and quickly settle. The water will be collected in the lower layer of the liquid stored in the liquid storage tank, over which a solvent having a substantially low water concentration will be located. Even fine colloidal particles of water that can pass through the mesh of a conventional water separation filter can be hereby removed, so that a high-purity solvent with the minimal water content can be recovered. As a result, various problems (e.g. damages to the clothes, inadequate dryness of the clothes, or multiplication of bacteria) caused by the mixture of water into the solvent will be prevented. If an expensive solvent, such as a silicone solvent is used, the running costs of the dry-cleaning machine can be reduced by recycling the solvent many times.

In a mode of the dry-cleaning machine according to the third aspect of the present invention, the coarse particle maker includes:

a compartment immersed in the solvent located over the water within the liquid storage tank due to the difference in relative density between the water and the solvent, and separated from the surrounding space by a filter member for turning colloidal particles of water in the solvent into coarse particles; and a pressure supplier for sending the water-containing solvent into the compartment.

In this construction, when the pressure supplier forcefully sends the water-containing solvent into the compartment of the coarse particle maker, the solvent within the compartment will be more compressed, attempting to pass through the filter member forming the compartment from inside to outside. Through this process, fine colloidal particles of water mixed in the solvent are separated into water and the solvent, and particles of this water gather to form larger particles. After passing through the filter member to the outside, they will be relatively large water particles, which will quickly settle due to their relative density and form a water layer at the bottom. A common example of the pressure supplier is a pressure pump.

This construction makes it possible to raise the solvent-processing speed of the coarse particle maker by applying an appropriate pressure on the filter member. Since the compartment surrounded by the filter member is installed inside the liquid storage tank and the pressure supplier sends the solvent into that compartment, there is no need to provide another housing or similar structure for forming the compartment apart from the liquid storage tank. This is advantageous for creating a simpler, smaller and less expensive structure.

In a preferable mode of the previous construction, the pressure supplier draws the solvent located in the upper layer of the liquid storage tank from the outside of the compartment and sends it into the compartment.

In this construction, the solvent that has passed through the filter member can be drawn again by the pressure supplier. This means that the same solvent can cyclically and repeatedly pass through the filter member of the coarse particle maker. Colloidal particles that cannot be removed from the solvent by a one passing cycle will be turned into coarse particles and removed by repeating the process. Thus, the water contained in the solvent will be further surely removed, so that the water concentration will be further lowered.

In the previously described construction, the pressure supplier may draw foreign matter, such as lint mixed in the solvent, and cause problems. Furthermore, the foreign matter may stick to the filter member of the coarse particle maker. If this occurs, the filter will be easily clogged and it will be necessary to frequently clean or exchange the filter. To avoid this problem, it is preferable to provide a foreign matter removal filter for removing foreign matter from the solvent at the solvent-drawing port of the pressure supplier. This filter prevents foreign matter mixed in the solvent from being caught in the pressure supplier or sticking to the filter member, thus reducing the maintenance workload.

In the previously described construction, it is preferable that the pressure flow rate of the pressure supplier be adequately higher than the flow rate of the solvent coming into the liquid storage tank. According to this setting, the processing speed of the coarse particle maker will be higher than the speed of increase of the colloidal particles coming into the liquid storage tank. Therefore, even when the condensed solvent is being collected into the liquid storage tank, the number of colloidal particles in the solvent in the liquid storage tank will be reduced and thereby the water will be further removed.

In a preferable mode of the third aspect of the present invention, the dry-cleaning machine further includes:

a solvent selection filter for receiving a solvent from which a portion or entirety of the water mixed in it has been removed by the coarse particle maker, and for selectively allowing only the solvent to pass through it; and a solvent recovery structure for recovering the solvent that has passed through the solvent selection filter.

In a specific mode of the previous construction, the solvent recovery structure includes:

a low-purity solvent storage section into which the solvent that has passed through the coarse particle maker is to be introduced, this section being independent of the liquid storage tank or formed as a compartment created by partitioning the inside of the liquid storage tank;

a high-purity solvent storage section immersed in the low-purity solvent stored in the low-purity solvent storage section and separated from the low-purity solvent by the solvent selection filter; and a solvent recovery pipe for extracting the high-purity solvent from the high-purity solvent storage section.

In this construction, even before the coarse particles of water produced by the coarse particle maker completely settles, if they are large enough to be blocked by a water separation filter, it is possible to extract a high-purity solvent by passing the solvent with the water particles mixed in it through the solvent selection filter. Therefore, the water can be removed at higher speeds and the solvent can be extracted with higher purity.

In the dry-cleaning machine according to the third aspect of the present invention, the filter member of the coarse particle maker may use activated carbon. Being highly adsorptive to solvents, the activated carbon is capable of stripping the solvent from the surface of the water particles to separate the solvent and the water, thus helping the fine water particles to aggregate into larger particles.

If the filter consists of only an activated carbon filter, water particles that have grown larger are difficult to separate off the filter surface. To help their separation, the filter member of the coarse particle maker may preferably have layers of activated carbon and non-woven fabric arranged in this order in the passing direction of the solvent. In this construction, water particles that have grown to a certain size easily separate off the filter member and settle due to their relative density.

To make the activated carbon more adsorptive to the solvent, the filter member using the activated carbon may be soaked with the solvent in advance. This pre-treatment will improve the efficiency of turning colloidal particles into coarse particles and accordingly enhance the water-removing efficiency.

The water separator of the dry-cleaning machine according to the present invention is also applicable to the separation of water from a petroleum solvent. However, in petroleum solvents, water scarcely forms a dispersion of colloidal particles and can be separated in a relatively short time only by relative density difference separation. Therefore, it is not so necessary to use the water separator having the previously described construction. By contrast, silicone solvents are generally characteristic in that water can easily form a dispersion of colloidal particles and create an emulsion during the condensation process. Moreover, since their relative densities are close to that of water, it tends to take a long time to separate a silicone solvent and water if only a relative density difference separation method is used. Therefore, the dry-cleaning machine according to the third aspect of the present invention is also particularly useful for a dry-cleaning machine that cleans laundry with a silicone solvent.

Effect of the Invention

As described thus far, the dry-cleaning machine according to the first or second aspect of the present invention restrains the interface created between the solvent and water due to their relative density difference, from making an undesirable motion under wind pressure. As a result, the clogging of the filter and the flow-out of the solvent, both of which impede the recovery of high-purity solvent, are prevented. Even if water is mixed in a silicone solvent or similar solvent whose relative density is close to that of water and hence the water cannot easily be separated only by relative density difference separation, the water can be quickly separated from the solvent to efficiently recover a high-purity solvent.

In the dry-cleaning machine according to the third aspect of the present invention, even if water is mixed in a silicone solvent or similar solvent whose relative density is close to that of water and which is easy to form an emulsion, the water can be quickly separated from the solvent to efficiently recover a high-purity solvent.

BEST MODES FOR CARRYING OUT THE INVENTION

Figure 1:
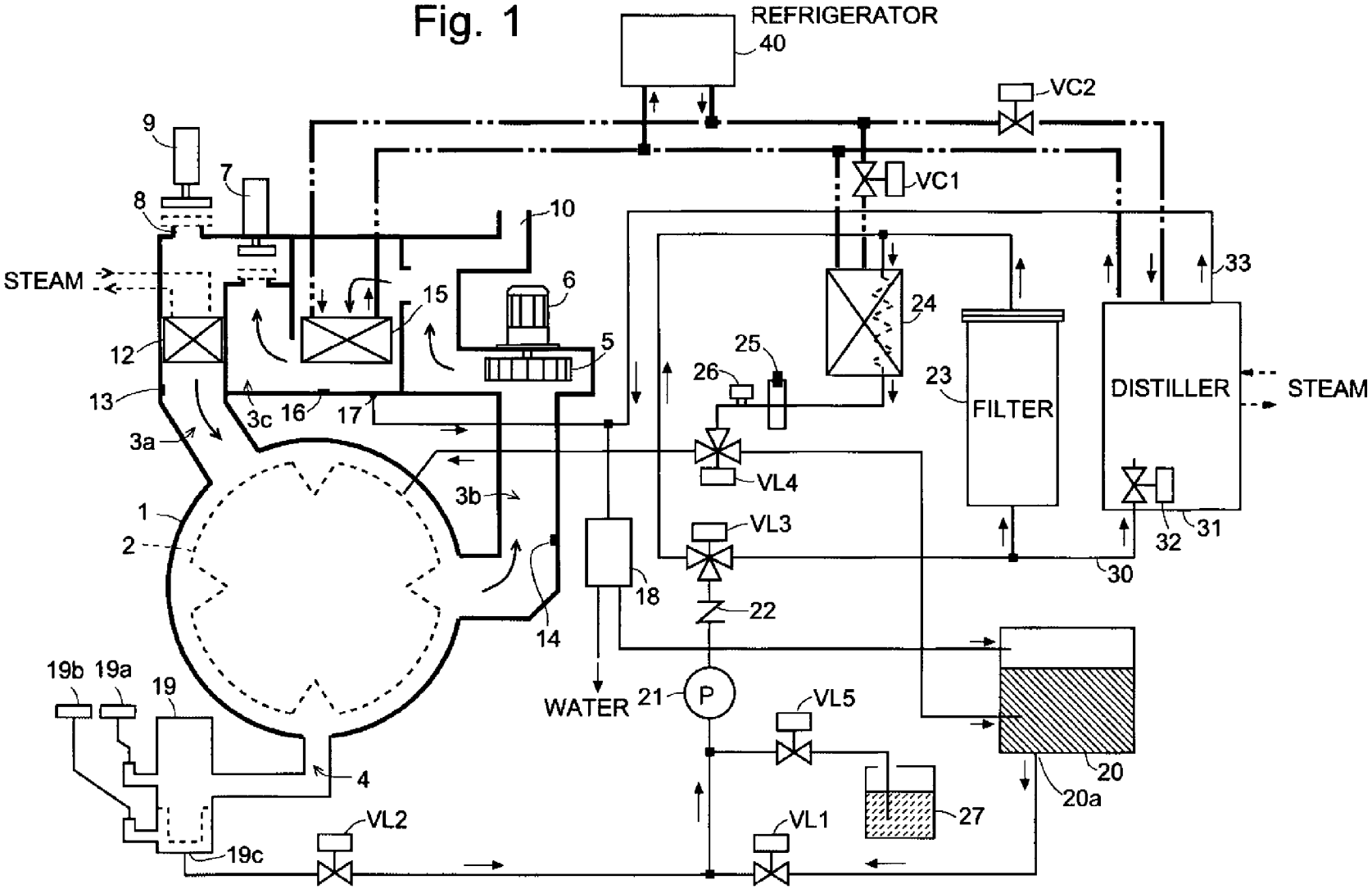
FIG. 1 is a structural diagram of a dry-cleaning machine as an embodiment (first embodiment) of the present invention, mainly showing the pipe arrangement and related components.

An embodiment (first embodiment) of the dry-cleaning machine according to the first and second aspects of the present invention is described with reference to the drawings. FIG. 1 is a structural view of the dry-cleaning machine according to the first embodiment, primarily showing the solvent passage and air passage.

Within an outer tub 1, a cylindrical drum 2 having a large number of liquid-passing holes in the circumferential wall is supported by a rotary shaft. An inlet-side air passage 3*a*, outlet-side air passage 3*b* and solvent drainage passage 4 are connected to the wall of the outer tub 1. The inlet-side air passage 3*a*, the outer tub 1, the outlet-side air passage 3*b* and an upper air passage 3*c* as a whole constitute an air-circulation passage. A blower 5, which is rotated by a blower motor 6, generates a drawing force, which produces an air current through the air-circulation passage, as indicated by arrows in FIG. 1. Between the upper air passage 3*c* and the inlet-side air passage 3*a*, a gate valve 7 is provided for switching the open/close states of the passage. Located immediately downstream from the gate valve 7 is an intake port 8, which can be closed by an intake valve 9. An exhaust port 10 is located immediately downstream from the blower 5.

A steam-heating type drying heater 12 is located within the inlet-side air passage 3*a*, with a drum inlet temperature sensor 13 located downstream from the drying heater 12. The drying heater 12 includes a pipe, into which hot steam (normally, at a temperature from 100 to 120 degrees Celsius) is supplied from a boiler (not shown) located outside the machine according to necessity. This steam is later returned to the boiler. The air passing through the inlet-side air passage 3*a* is heated by the drying heater 12 and sent into the outer tub 1. Within the outlet-side air passage 3*b*, a drum outlet temperature sensor 14 is provided for measuring the temperature of the air that has passed through the drum 2.

Within the upper air passage 3*c*, a drying cooler 15 is located between the gate valve 7 and the exhaust port 10, with a cooler temperature sensor 16 located downstream from the drying cooler 15. The heat exchanger of the drying cooler 15 includes a pipe, through which a coolant condensed by a refrigerator 40 located outside the machine is circulated according to necessity. The air coming from the outlet-side air passage 3*b* is rapidly cooled at the heat exchanger of the drying cooler 15, whereby the vaporized solvent contained in the air is condensed into a liquid form and drips off. The air contains not only the vaporized solvent but also steam, which results from water originally retained in the laundry. Therefore, the liquid produced by condensation contains a small quantity of water in addition to the solvent. This liquid, i.e. the liquid mixture, flows out from the drainage port 17 and reaches a water separator 18, which corresponds to the water separator in the present invention. The water separator removes water from the liquid mixture, and only the solvent is collected into the solvent tank 20.

The drainage line 4 is connected to the bottom of the outer tub 1. This line leads to a button trap 19 having a normal level switch 19*a*, which detects that the solvent in the drum 2 is at a predetermined level, and a drainage level switch 19*b*, which detects that the solvent has been discharged from the outer tub 1. The button trap 19 is a filter for removing solid items, such as a clothes button, which may be contained in the discharged solvent. The supply port 20*a* of the solvent tank 20 and the drainage port 19*c* of the button trap 19 are connected to a common line via a supply valve VL1 and a drainage valve VL2, respectively, and the common line leads to the suction port of the pump 21. The eject port of the pump 21 is connected via the check valve 22 to either the inlet or outlet of the solvent filter 23, depending on the setting of a first three-way valve VL3. The solvent filter 23 consists of a paper filter, activated carbon filter and other elements; it removes impurities, such as fine dust, from the solvent.

The outlet of the solvent filter 23 is also connected to a solvent cooler 24. The solvent cooler 24 includes a heat exchanger having a pipe through which the coolant supplied from the refrigerator 40 is circulated according to necessity. The heat exchanger cools the solvent by exchanging heat with the solvent. A solvent temperature sensor 25 and a soap concentration sensor 26 are located in the passage downstream from the solvent cooler 24. This passage leads to either the outer tub 1 or solvent tank 20, depending on the setting of a second three-way valve VL4. A soap storage tank 27 is connected to the suction port of the pump 21 via a soap supply valve VL5. The inlet of the solvent filter 23 is also connected to the distiller 31 via a tainted solvent supply passage 30. The solvent outlet of the distiller 31 is connected via a purified solvent flow-out passage 33 and the water separator 18 to the solvent tank 20.

In the solvent circulation passage having the construction described thus far, when the solvent is to be supplied into the outer tub 1 to perform a cleaning operation, the valves are operated as follows: the drainage valve VL2 is closed; the supply valve VL1 is opened; the second three-way valve VL4 is turned to connect the outlet of the solvent cooler 24 to the outer tub 1; and the first three-way valve VL3 is turned to connect the eject port of the pump 21 to the inlet of the solvent filter 23. With the valves thus set, the pump 21 is energized. Another valve, i.e. the tainted solvent supply valve 32 located on the tainted solvent supply passage 30 within the distiller 31, is closed. Then, the solvent stored in the solvent tank 20 flows through the supply valve VL1, pump 21, first three-way valve VL3, solvent filter 23, solvent cooler 24 and second three-way valve VL4, into the outer tub 1. This passage setting is hereinafter called the "solvent supply passage." The solvent is supplied from the solvent tank 20 to the outer tub 1 until the normal level switch 19*a* detects that a predetermined amount of solvent has been stored in the outer tub 1.

When the normal level switch 19*a* detects that the solvent has reached the predetermined level, the supply valve VL1 is closed and the drainage valve VL2 is opened. Then, the solvent stored in the outer tub 1 circulates through the drainage line 4, drainage valve VL2, pump 21, first three-way valve VL3, solvent filter 23, solvent cooler 24 and second three-way valve VL4, back into the outer tub 1. While the solvent is circulating during the cleaning operation as described earlier, the button trap 19 catches any solid items coming off the laundry and the solvent filter 23 purifies the solvent. In the cleaning operation, soap is dispensed so that the solvent has an appropriate soap concentration for the purposes of enhancing the detergency and the antistatic effect, as will be described later. To dispense the soap, the soap supply valve VL5 is opened while the pump 21 is running.

To discharge the solvent from the outer tub 1, the valves are operated as follows: the drainage valve VL2 is opened; the supply valve VL1 is closed; the first three-way valve VL3 is turned to connect the eject port of the pump 21 to the inlet of the solvent filter 23; and the second three-way valve VL4 is turned to connect the outlet of the solvent cooler 24 to the solvent tank 20. With the valves thus set, the pump 21 is energized. Then, the solvent flows from the outer tub 1, through the drainage line 4, button trap 19, drainage valve VL2, pump 21, first three-way valve VL3, solvent filter 23, solvent cooler 24 and second three-way valve VL4, back into the solvent tank 20. This passage setting is hereinafter called the "solvent drainage passage." In this case, the solvent filter 23 purifies the solvent when the solvent returns to the solvent tank 20. During this process, the coolant may be supplied into the solvent cooler 24 to cool down the solvent.

In an operation mode where the solvent is not supplied into the outer tub 1, the valves are operated as follows: the supply valve VL1 is opened; the drainage valve VL2 is closed; the first three-way valve VL3 is turned to connect the eject port of the pump 21 to the inlet of the solvent filter 23; and the tainted solvent supply valve 32 inside the distiller 31 is opened. With the valves thus set, the pump 21 is energized. Then, the solvent flows from the solvent tank 20, through the supply valve VL1, pump 21, first three-way valve VL3 and tainted solvent supply passage 30, into the distiller 31, which purifies the solvent by distillation. The solvent thus purified flows through the purified solvent flow-out passage 33 and water separator 18, back into the solvent tank 20. This passage setting is hereinafter called the "solvent purification passage." Thus, the distiller 31 purifies the solvent while the solvent is circulating.

Figure 2:
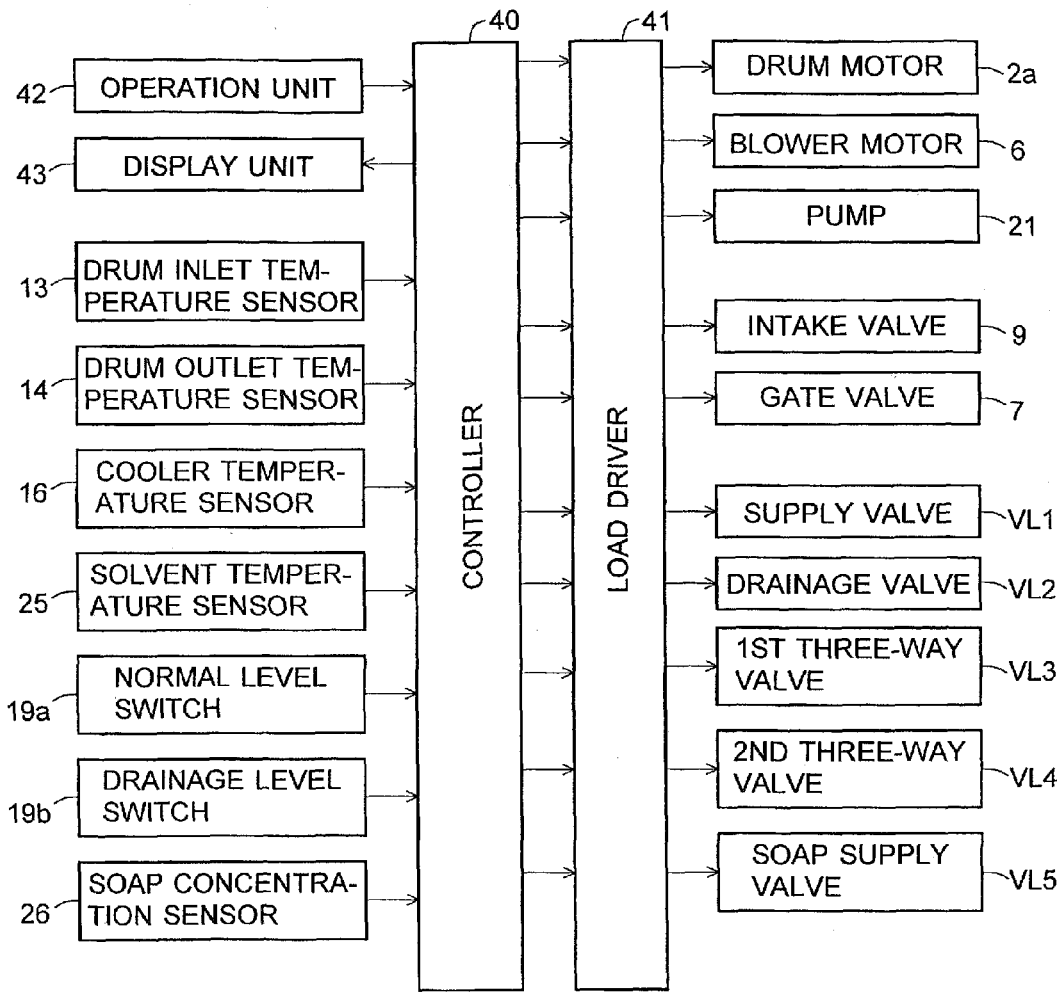
FIG. 2 is a block diagram showing the electrical system of the dry-cleaning machine according to the first embodiment.

The electrical system of the present dry-cleaning machine is described with reference to FIG. 2. The controller 40, which consists of a microcomputer and other components, includes a central processing unit (CPU), a read-only memory (ROM) in which an operation control program is stored, and a random access memory (RAM) for reading and writing various kinds of data required for operation and other purposes. An operation unit 42 with input keys and other parts and a display unit 43 with a display panel for showing numerical values and other information are connected to the controller 40. Also connected are the following sensors and switches, which have already been mentioned: drum inlet temperature sensor 13, drum outlet temperature sensor 14, cooler temperature sensor 16, solvent temperature sensor 25, normal level switch 19*a*, drainage level switch 19*b* and soap concentration sensor 26.

Receiving detection signals from those sensors and switches, the controller 40 sends control signals to the load driver 41 according to the operation control program. Through the load driver 41, the controller 40 operates the drum motor 2*a*, blower motor 6, pump 21, intake valve 9, gate valve 7, supply valve VL1, drainage valve VL2, first three-way valve VL3, second three-way valve VL4, soap supply valve VL5 and other components.

Figure 3:
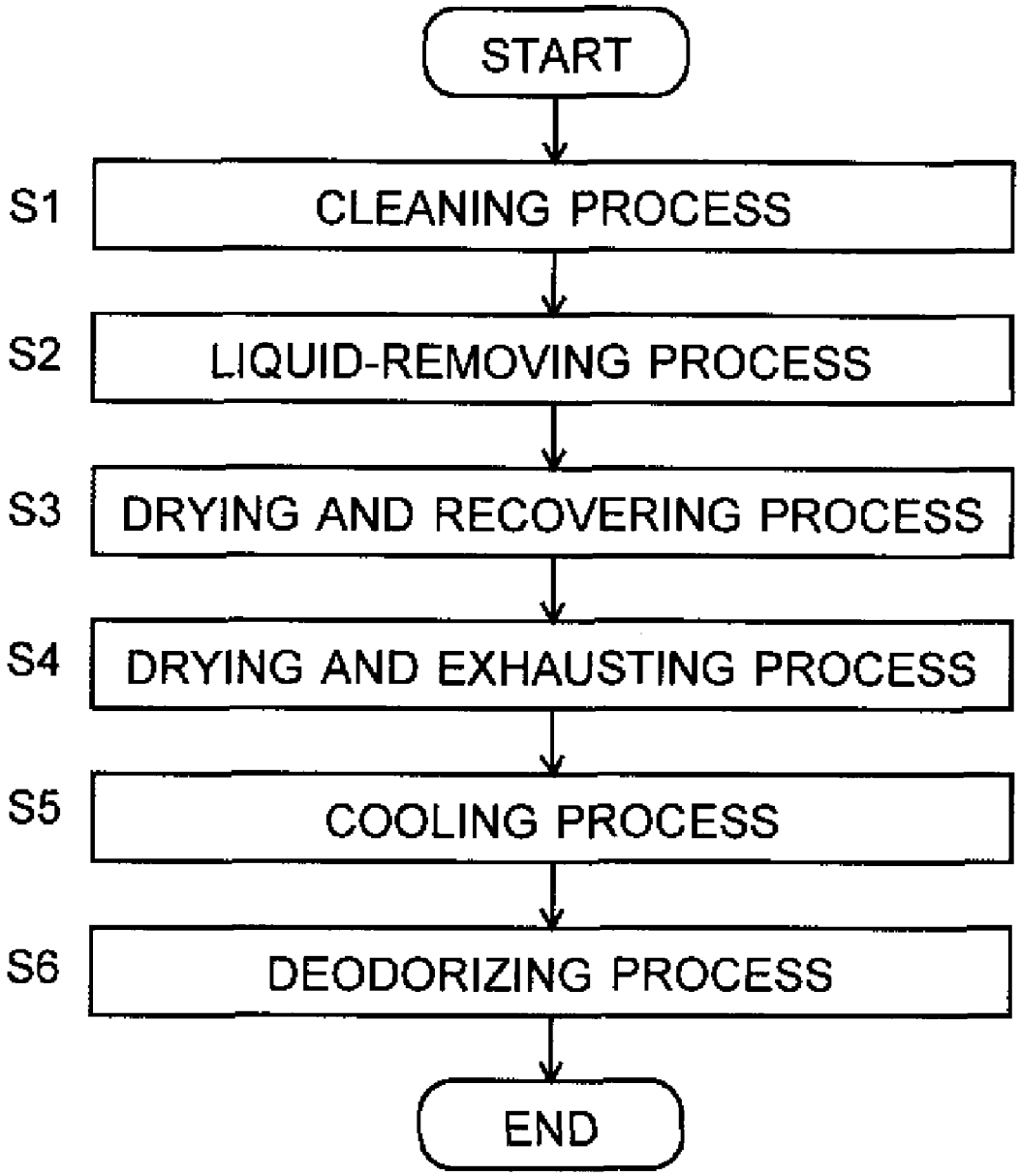
FIG. 3 is a flow chart showing the process steps of cleaning the laundry by the dry-cleaning machine according to the first embodiment.

With reference to the flow chart of FIG. 3, the process steps of cleaning the laundry by the present dry-cleaning machine are described.

[Step S1] Cleaning Process

The operator puts the laundry into the drum 2 and operates the operation unit 42 to enter setting information required for each process step. After the setting is completed, the operator presses the start key on the operation unit 42 to instruct the machine to begin the operation. Then, the controller 40 drives the drum motor 2*a* so that the drum 2 intermittently rotates in the reverse direction at a low speed (e.g. approximately 30 to 50 rpm). Simultaneously, the solvent supply passage is set up and the solvent is supplied from the solvent tank 20 into the outer tub 1 until a predetermined amount of the solvent is stored in the tub 1.

When the normal level switch 19*a* detects that the solvent has reached the predetermined level, the supply valve VL1 is closed and the drainage valve VL2 is opened. Then, the solvent 1 stored in the outer tub 1 circulates through the drainage line 4, drainage valve VL2, pump 21, first three-way valve VL3, solvent filter 23, solvent cooler 24 and second three-way valve VL4, back into the outer tub 1. While the solvent is circulating during the "beat-washing" process with the drum 2 alternately rotating, the button trap 19 catches any solid items coming off the laundry and the solvent filter 23 purifies the solvent. In the cleaning operation, soap is dispensed so that the solvent has an appropriate soap concentration for the purposes of enhancing the detergency and the antistatic effect, as will be described later. To dispense the soap, the soap supply valve VL5 is opened while the pump 21 is running.

[Step S2] Liquid-Removing Process

After a predetermined cleaning time (e.g. seven minutes) has elapsed, the solvent drainage passage is set up to recover the solvent from the outer tub 1 to the solvent tank 20. When the drainage level switch 19*b* detects that the drainage has been completed, the drum 2 is rotated in the normal direction at a high speed (e.g. 400 to 600 rpm). Meanwhile, the drainage process is continued, as described later, so that the solvent removed from the laundry returns to the solvent tank 20. After a predetermined liquid-removing time has elapsed, the drum 2 is stopped and the liquid-removing process is discontinued. Once it is used in the cleaning process, the solvent is tainted with soap. To remove this soap and other contaminants, the solvent purifying line is set up so that the solvent is circulated through the distiller 31, which gradually purifies the solvent. This solvent-purifying operation can be performed during the drying process, which will be described later, or anytime.

[Step S3] Drying and Recovering Process

Next, the drying and recovering process is performed as the first drying stage. In the drying and recovering process, the controller 40 intermittently rotates the drum 2 back and forth at a low speed, while energizing the blower motor 6, drying heater 12 and drying cooler 15. In this process, the intake valve 9 is closed and the gate valve 7 is opened. This valve setting creates the air-circulation passage in which an air current flows from the inlet-side air passage 3*a*, through the outer tub 1, outlet-side air passage 3*b* and upper air passage 3*c*, and back to the inlet-side air passage 3*a*. Through this air-circulation passage, a current of hot air produced by the drying heater 12 is supplied into the outer tub 1. After passing through the liquid-passing holes of the drum 2, the air contains the solvent vaporized from the laundry. This hot air with the vaporized solvent reaches the drying cooler 15, where the vaporized solvent is cooled and condensed into a liquid form. With the solvent thus removed, the air, now dry, passes through the drying heater 12 to be heated again and returns to the outer tub 1.

In the drying and recovering process, to assuredly prevent a fire or similar accident, a temperature control is performed to maintain the concentration of vaporized solvent within the air-circulation passage under a safety level. The concentration of vaporized solvent within the air-circulation passage depends on the difference ΔT between the temperature of the hot air detected by the drum inlet temperature sensor 13 and that of the air detected by the drum outlet temperature sensor 14; the latter temperature is lower since the air loses heat when it vaporizes the solvent from the laundry. Accordingly, the amount of steam supplied to the drying heater 12 is controlled so that the temperature difference ΔT is maintained under a predetermined value, e.g. 10 to 20 degrees Celsius or lower. With the concentration of vaporized solvent within the air-circulation passage thus maintained under the safety level, the drying process is carried out.

[Step S4] Drying and Exhausting Process

After the drying and recovering process is continued for a predetermined period of time, the drying and exhausting process is started. In this process, the gate valve 7 and the intake valve 9 are opened, while the blower motor 6, drying heater 12 and drying cooler 15 are maintained in operation. Then, a portion of the circulating air is discharged through the exhaust port 10 to the outside of the machine, and that portion is replaced by fresh air introduced from the intake port 8. This air is merged into the circulating air, heated by the drying heater 12 and supplied into the drum 2.

[Step S5] Cooling Process

After the predetermined drying and exhausting time has elapsed, the cooling process is started. In this process, the intake valve 9 is closed again and, while the drum 2 is rotated in the reverse direction, the steam supply to the drying heater 12 is stopped to discontinue the heating. Then, cold air produced by the drying cooler 15 is supplied into the drum 2 to cool down the laundry.

[Step S6] Deodorizing Process

After the cooling process is continued for a predetermined period of time, the cooling operation of the drying cooler 15 is discontinued. Then, the intake valve 9 is fully opened and the gate valve 7 is closed. As a result, the fresh air coming from the intake port 8 flows through the inlet-side air passage 3*a*, outer tub 1, and outlet-side air passage 3*b*, and is exhausted through the exhaust port 10 to the outside. This process removes the solvent odor remaining in the laundry. After the deodorizing process is continued for a predetermined period of time, the drum 2 is stopped. Thus, the entire cleaning operation is completed.

In the construction of FIG. 1, the exhaust port 10 is located between the blower 5 and the drying cooler 15. Alternatively, it is possible to provide the exhaust port 10 with an exhaust valve and locate it between the drying cooler 15 and the gate valve 7. In this case, in the drying and exhausting process, the gate valve 7, intake valve 9 and exhaust valve are opened, while the blower motor 6, drying heater 12 and drying cooler 15 are maintained in operation. Then, a portion of the air that has passed through the drying cooler 15 is discharged through the exhaust port 10 to the outside of the machine, and that portion is replaced by fresh air introduced from the intake port 8. This air is merged into the circulating air, heated by the drying heater 12 and supplied into the drum 2. In this construction, the entirety of the air emitted from the drum 2 is cooled by the drying cooler 15. Therefore, the solvent contained in the air is efficiently recovered; inversely, the solvent content of the air exhausted from the exhaust port 10 is significantly lowered. Therefore, the amount of an expensive silicone solvent to be replenished is reduced. Furthermore, the amount of the solvent released to the ambience of the machine is greatly reduced, so that the working environment is effectively improved.

The dry-cleaning machine according to the first embodiment is characterized by the water separator 18 for separating and removing water from the solvent condensed during the drying and recovering operation or drying and exhausting operation. The following description focuses on the detailed construction and operation of the water separator 18, referring to FIG. 4.

Figure 4:
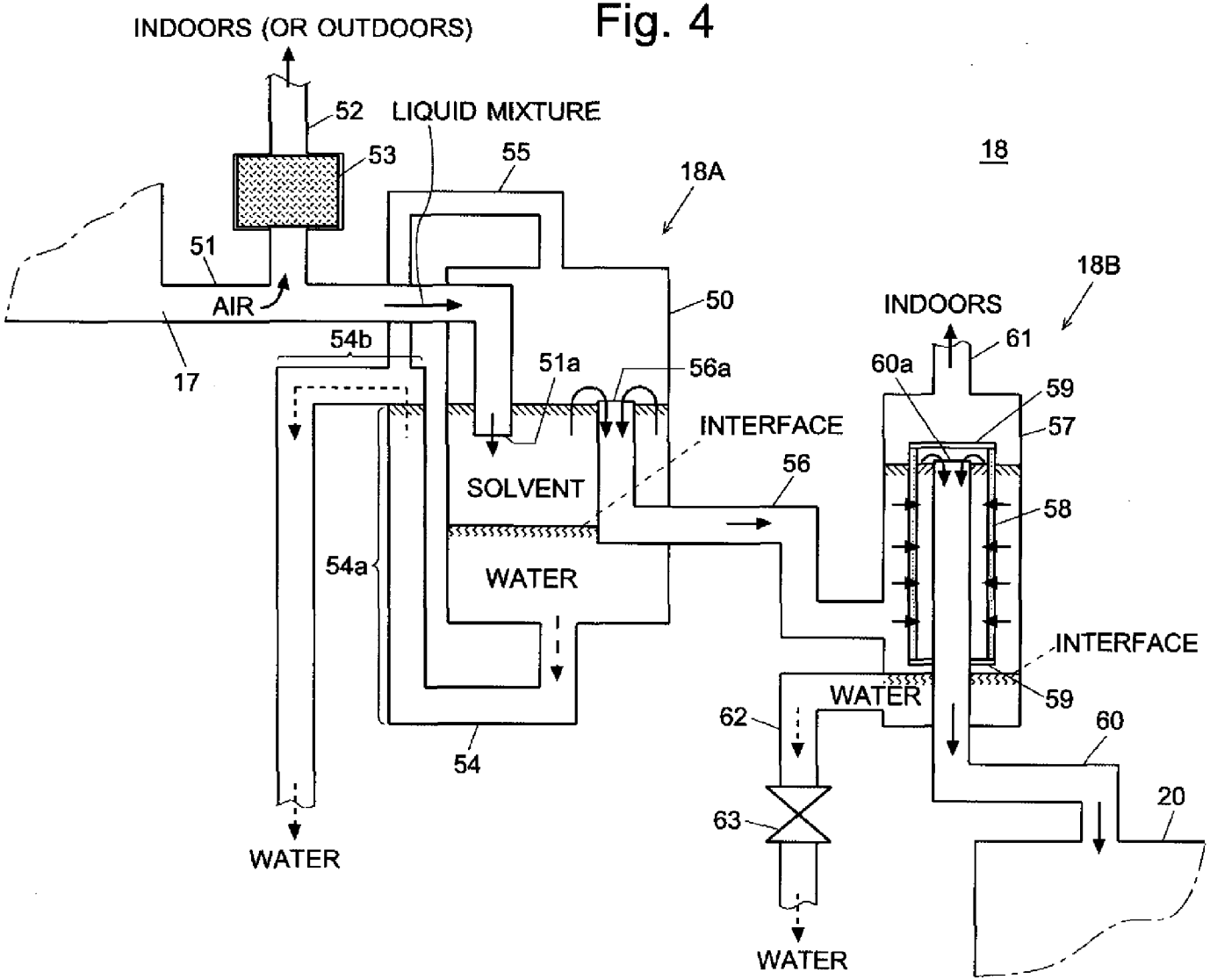
FIG. 4 is a schematic sectional view of the water separator in the dry-cleaning machine according to the first embodiment.
Figure 7:
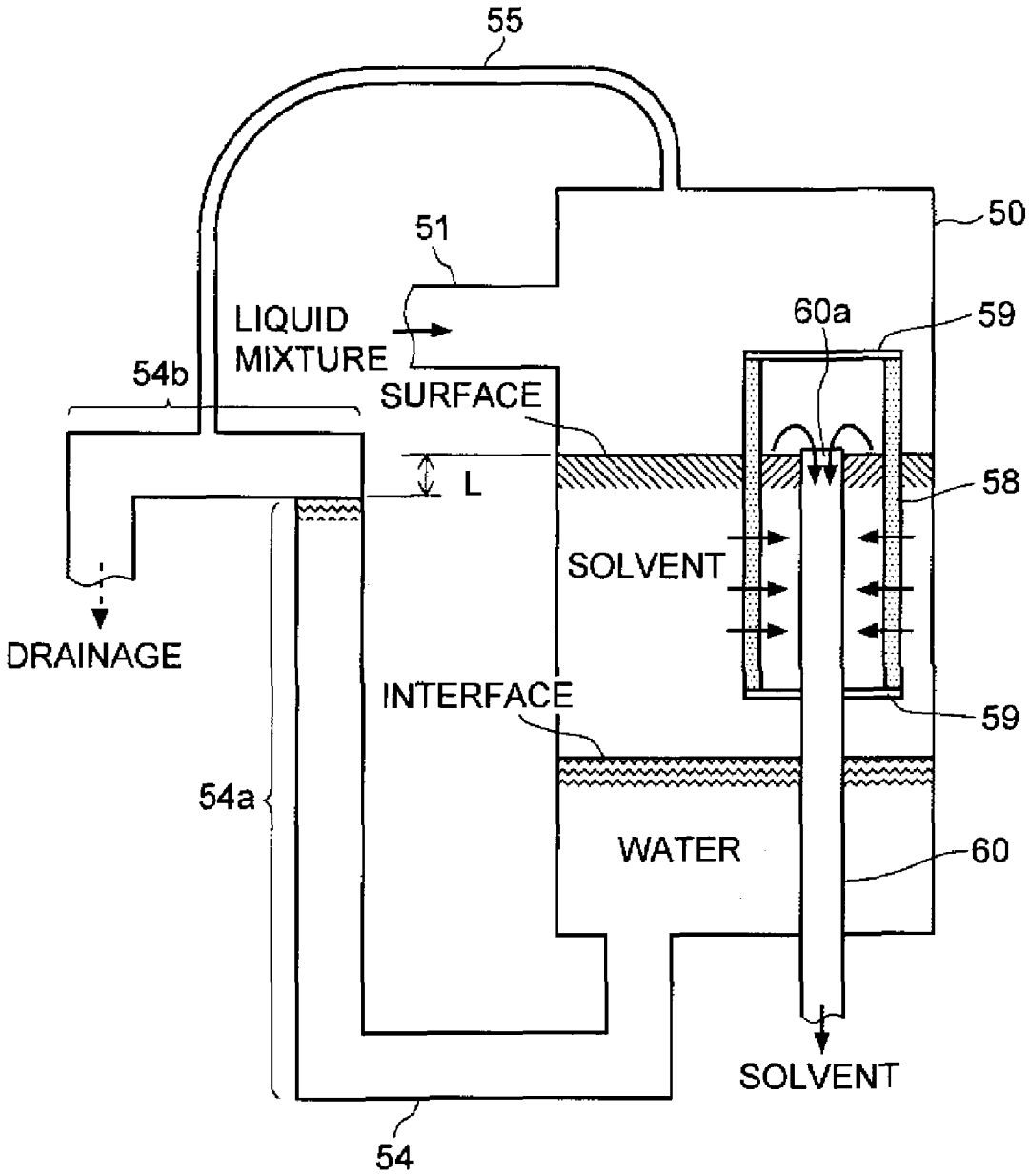
FIG. 7 is a schematic sectional view of a conventional water separator.

FIG. 4 is a vertical sectional view of the water separator 18 used in the present embodiment. In FIG. 4, the components that are functionally equivalent to those of the water separator previously described in FIG. 7 are indicated by the same numerals; explanation of those components will be omitted unless it is especially necessary. The liquid storage tank 50 in FIG. 7 is called the "first" liquid storage tank 50 in FIG. 4 to distinguish it from another liquid storage tank. This remark also applies to the drainage pipes.

In this water separator 18, an air relief pipe 52 having an activated carbon filter 53 is connected to an intermediate point of the liquid mixture line 51, which guides the liquid mixture from the drainage port 17 to the first liquid storage tank 50. This pipe 52 corresponds to the air relief section in the present invention. The activated carbon filter 53 catches the vaporized solvent contained in the air exhausted through the air relief pipe 52. The activated carbon filter 53 may be omitted if a small amount of leakage of the vaporized solvent is allowable, for example if the air relief pipe 52 is extended so that its outlet is located outdoors and the air is exhausted outdoors directly.

The outlet end 51*a* of the liquid mixture line 51 is not connected to the wall of the first liquid storage tank 50; it is further extended into that tank 50, then bent downwards and immersed open in the low-purity solvent having a relatively large water content located in the upper layer within the first liquid storage tank 50. Behind the first separator 18A, whose main component is the first liquid storage tank 50, a second separator 18B is provided. The second separator 18B includes a second liquid storage tank 57 containing a liquid-liquid separation filter; this filter was conventionally set within the first liquid storage tank 50.

In the first separator 18A, the first liquid storage tank 50 contains a solvent collection pipe 56 having a solvent outlet 56*a*. This outlet is positioned so that the low-purity solvent in the upper layer separated due to the difference in relative density between the solvent and water flows into it when the solvent level is in the vicinity of the horizontal section 54*b* of the first drainage pipe 54. The exit end of the solvent collection pipe 56 is connected to the side wall of the second liquid storage tank 57. The structure of the first drainage pipe 54 is the same as shown in FIG. 7.

In the second separator 18B, the second liquid storage tank 57 contains a cylindrical solvent selection filter 58 made of micro-fiber non-woven fabric held by a holder 59. This filter corresponds to the filter chamber in the present invention. Inside this filter, the upper end port 60*a* of the solvent recovery pipe 60 penetrating the bottom of the second liquid storage chamber 57 is located open to the inner space. A second drainage pipe 62 with a valve 63 is connected to the lower portion of the second liquid storage tank 57, and an exhaust pipe 61 is connected to its upper portion. An end of the exhaust pipe 61 is located open to the air. Alternatively, for example, it may be connected to the air pipe 55.

The water separator 18 functions as follows: During the drying and recovering operation, a liquid mixture produced by the cooling and condensing effect of the drying cooler 15 flows from the drainage port 17 through the liquid mixture line 51 into the first liquid storage tank 50. An air current generated by the blower 5 also enters the liquid mixture line 51 from the drainage port 17. However, most of this air is discharged through the air relief pipe 52 to the outside. Particularly, the outlet end 51*a* of the liquid mixture line 51 is immersed in the solvent so that it receives a hydraulic pressure according to its depth. This hydraulic pressure is higher than the atmospheric pressure at the exit of the air relief pipe 52. Therefore, the air coming from the upper air passage 3*c* into the liquid mixture line 51 flows into the air relief pipe 52 since its flow resistance is lower. Thus, the air is prevented from rushing into the first liquid storage tank 50, and the interface between the solvent and water in the upper and lower layers separated within the first liquid storage tank 50 due to their relative density difference is stabilized. The interface thus stabilized will never descend to a level where the solvent can be discharged through the first drainage pipe 54.

As explained earlier, the liquid mixture in the first liquid storage tank 50 is separated into the solvent in the upper layer and the water in the lower layer due to their relative density difference; however, if a silicone solvent is used, the relative density difference is small and the water cannot be adequately separated, so that the purity of the solvent in the upper layer is low (hence, it is called the "low-purity solvent" here). After the solvent level within the first liquid storage tank 50 rises above the solvent outlet 56*a*, the low-purity solvent flows through the solvent collection pipe 56 into the second liquid storage tank 57. Meanwhile, the water level within the vertical section 54*a* of the first drainage pipe 54 also rises. When it reaches the horizontal section 54*b*, which corresponds to the bent section in the present invention, the water is discharged to the outside. The air pipe 55 prevents the first drainage pipe 54 from being negatively pressured and working as a siphon after a predetermined amount of water is discharged through the horizontal section 54*b*. If the water level within the first drainage pipe 54 falls below the horizontal section 54*b* according to a decrease in the level of the low-purity solvent, the flow of water through the first drainage pipe 54 immediately stops.

The liquid mixture flowing into the first liquid storage tank 50 contains dust, fine lint and other unwanted matter that have come off the laundry. Due to their relative densities, most of this unwanted matter gathers around the interface between the water and the low-purity solvent. In the first separator 18A, the interface will never rise above the solvent outlet 56*a*; most of the unwanted matter remains within the first liquid storage tank 50 and is prevented from flowing into the second liquid storage tank 57.

When the low-purity solvent is collected in the second liquid storage tank 57, the solvent containing a small amount of water attempts to pass through the solvent selection filter 58. While the solvent passes through the fiber mesh of the filter 58, the water is condensed on the fiber surface and forms large drops; this is because the fiber of filter 58 has specific qualities and a specific mesh density so that the filter differently affects the solvent and the water according to their differences in surface tension and other properties. Then, due to their weight (or relative density difference from that of the solvent), the drops of water settle and gather at the bottom of the second liquid storage tank 57. With the increase in the level of the low-purity solvent within the second liquid storage tank 57, the level of the high-purity solvent within the space surrounded by the filter 58 (this space corresponds to the high-purity solvent storage section in the present invention) also increases. When the solvent level rises above the upper end port 60*a*, the solvent flows into the solvent collection pipe 60 and is collected into the solvent tank 20.

Meanwhile, the water is collected at the bottom of the second liquid storage tank 57. Since the amount of water contained is the low-purity solvent is inherently small, the collecting speed of this water is low. Accordingly, as opposed to the first separator 18A, which is constructed so that the water is spontaneously discharged according to the liquid level, the second separator 18B is constructed so that water is discharged through the second drainage pipe 62 by opening the valve 63. Of course, it is possible to give the second drainage pipe 62 the same construction as the first drainage pipe 54.

As described thus far, a high-purity silicone solvent containing little or no water flows out from the solvent recovery pipe 60. The second liquid storage tank 57 is provided independent of the first liquid storage tank 50, and unwanted matter barely flows into the second liquid storage tank 57. Therefore, the solvent selection filter 58 will never be clogged by unwanted matter. Thus, the workload for cleaning and exchanging the filter 58 will be significantly reduced and the running costs will be lowered.

An embodiment (second embodiment) of the dry-cleaning machine according to the third aspect of the present invention is described with reference to the drawings. The overall construction of the solvent passage and air passage of the dry-cleaning machine of the second embodiment is the same as that of the dry-cleaning machine of the first embodiment. Accordingly, explanation of this construction is omitted. Also, the operation of the present dry-cleaning machine is the same as in the first embodiment.

The difference between the dry-cleaning machine of the second embodiment and the first embodiment exists in the construction of the water separator 18 for separating and removing water from a solvent obtained by distillation when a solvent that has been tainted during the cleaning operation is purified by the distiller 31, or from a solvent that has been obtained by condensation by the drying cooler 15 during the drying operation. The following description focuses on the detailed construction and operation of the present water separator 18, referring to FIG. 5.

Figure 5:
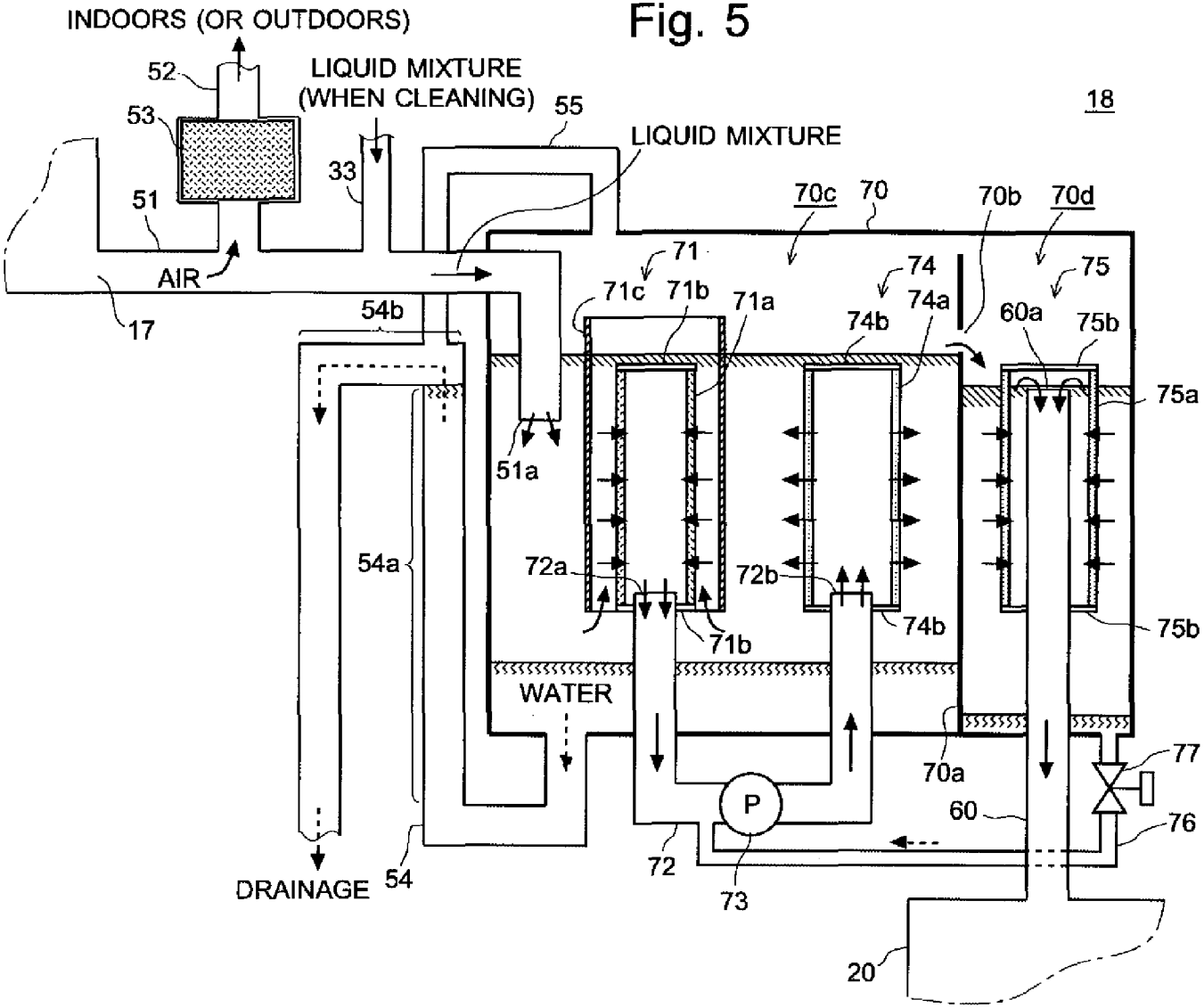
FIG. 5 is a schematic sectional view of the water separator in a dry-cleaning machine as another embodiment (second embodiment) of the present invention.

FIG. 5 is a vertical sectional view of the water separator 18 in the second embodiment. In FIG. 5, the components that are functionally equivalent to those of the water separators previously described in FIGS. 4 and 7 are indicated by the same numerals.

In this water separator 18, an air relief pipe 52 having an activated carbon filter 53 is connected to an intermediate point of the liquid mixture line 51, which guides the liquid mixture from the drainage port 17 to the liquid storage tank 70. The activated carbon filter 53 catches the vaporized solvent contained in the air exhausted through the air relief pipe 52. The activated carbon filter 53 may be omitted if a small amount of leakage of the vaporized solvent is allowable, for example if the air relief pipe 52 is extended so that its outlet is located outdoors and the air is exhausted outdoors directly.

The outlet end 51*a* of the liquid mixture line 51 is not connected to the wall of the liquid storage tank 70; it is further extended into that tank 70, then bent downwards at a right angle and immersed open in the solvent in the upper layer within the liquid storage tank 70.

The liquid storage tank 70 has a partition 70*a* standing on its bottom. This partition separates the inner space of the tank into two chambers: The first chamber 70*c* has the outlet end 51*a* of the liquid mixture line 51 located inside, and the main drainage pipe 54 (the same as the conventional one) is connected to it. The second chamber 70*d* has a sub drainage pipe 76 connected to its bottom; this pipe is provided with an electromagnetic valve 77 for drainage control. The upper end of the partition 70*a* is left open so that the first and second chambers 70*c* and 70*d* can communicate with each other. The partition also has a passage hole 70*b* at a predetermined position for allowing the solvent to flow from the first chamber 70*c* into the second chamber 70*d*.

The first chamber 70*c* contains a pre-filter unit 71 (which corresponds to the foreign matter removal filter in the third aspect of the present invention) and a coarse particle-making unit 74 (which corresponds to the coarse particle maker in the third aspect of the present invention), both being immersed in the solvent in the upper layer. The pre-filter unit 71 is connected to the coarse particle-making unit 74 by a circulation pipe 72 in which a pressure pump 73 (which corresponds to the pressure supplier in the third aspect of the present invention) is provided. The pre-filter unit 71 removes small foreign matter, such as lint or dust, from the liquid mixture coming through the liquid mixture line 51. This unit includes a cylindrical filter 71*a* held by a holder 71*b* and a cylindrical separation pipe 71*c* surrounding the filter 71*a*. Inside this filter 71*a*, the inlet end 72*a* of the circulation pipe 72 is located open to the space surrounded by the filter.

The coarse particle-making unit 74 helps fine colloidal particles of water contained in the solvent to be coarse particles and settle. The unit includes a cylindrical filter 74*a* held by a holder 74*b*. Inside this filter 74*b*, the outlet end 72*b* of the circulation pipe 72 is located open to the space surrounded by the filter (this space corresponds to the compartment of the coarse particle maker in the third aspect of the present invention). In the present embodiment, the filter 74*a* consists of an activated carbon filter 74*a*1 having a cylindrical body holding granular activated carbon, which is enveloped by a non-woven fabric filter 74*a*2. The activated carbon filter 74*a*1 was soaked with a silicone solvent beforehand to improve its affinity (adsorbing ability) to the solvent. The activated carbon filter 74*a*1 may use activated carbon fiber or other forms of activated carbon in place of the granular activated carbon.

Inside the second chamber 70*d*, a water separation filter unit 75 is immersed in the solvent in the upper layer. The water separation filter unit 75 allows the solvent to pass through it while preventing water from passing. This unit includes a cylindrical filter 75*a* held by a holder 75*b*. Inside this filter 75*a*, the upper end port 60*a* of a solvent recovery pipe 60 penetrating through the bottom of the liquid storage tank 70 is located open to the space surrounded by the filter.

The present water separator 18 functions as follows: Before the water-separating operation is started, the first and second chambers 70*c* and 70*d* of the liquid storage tank 70 contains the silicone solvent and water clearly separated in the upper and lower layers at predetermined levels, as shown in FIG. 5. Initially, the pressure pump 73 is off.

The pressure pump 73 is energized when a solvent containing water flows into the liquid storage tank 70, e.g. when the solvent purification passage is set up or when the drying and recovering operation is performed. The liquid mixture, which may be produced by, for example, the cooling and condensing effect of the drying cooler 15 during the drying and recovering operation, flows from the drainage port 17 through the liquid mixture line 51 into the liquid storage tank 70. An air current generated by the blower 5 also enters the liquid mixture line 51 from the drainage port 17. However, most of this air is released through the air relief pipe 52 to the outside. Particularly, the outlet end 51*a* of the liquid mixture line 51 is immersed in the solvent so that it receives hydraulic pressure according to its depth. This hydraulic pressure is higher than the atmospheric pressure at the exit of the air relief pipe 52. Therefore, the air coming from the upper air passage 3*c* into the liquid mixture line 51 flows into the air relief pipe 52 since flow resistance is lower. Thus, air is prevented from rushing into the liquid storage tank 70, and the interface between the solvent and water in the upper and lower layers separated within the liquid storage tank 70 due to their relative density difference is stabilized.

However, if a silicone solvent is used, the solvent and water easily form colloidal particles during the distillation by the distiller 31 or condensation by the drying cooler 15. In most cases, the liquid mixture freshly flowing into the liquid storage tank 70 takes the form of an emulsion containing a dispersion of colloidal particles. When it is running, the pressure pump 73 draws the solvent from the inlet end 72*a* (or from the space inside the filter 71*a* of the pre-filter unit 71) and forcefully transfers it to the outlet end 72*b* (or into the space inside the filter 74*a* of the coarse particle-making unit 74). By this drawing operation, the solvent located around the filter 71*a* within the pre-filter unit 71 passes through the mesh of the filter 71*a* to the inside. In this process, the filter 71*a* removes foreign matter from the solvent.

Since the circumference of the filter 71*a* is surrounded by the separation pipe 71*c*, the solvent is drawn upwards through the bottom opening of the separation pipe 71*c*. Due to this construction, any foreign matter in the liquid mixture discharged from the outlet end 51*a* of the liquid mixture line 51 will not be strongly drawn while it is settling; it will firstly come into the vicinity of the interface. At the interface, the foreign matter is considerably stable due to its relative density; only a small portion will be drawn away with the solvent. Thus, the amount of foreign matter to be captured by the filter 71*a* is reduced and its clogging is impeded. Another effect of the separation pipe 71*c* will be explained later.

Figure 6:
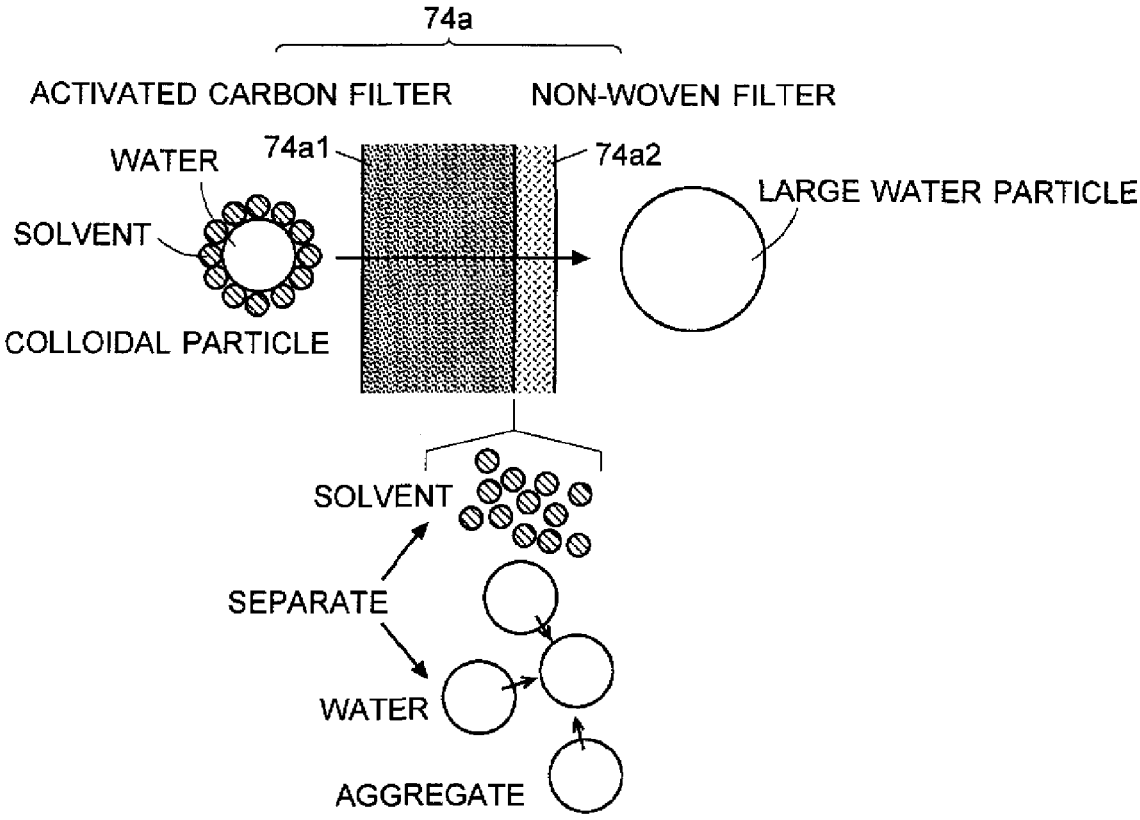
FIG. 6 is a conceptual diagram illustrating the process of turning colloid particles into a coarse particle in the water separator of the dry-cleaning machine according to the second embodiment.

Thus, the pre-filter 71 removes the foreign matter. However, colloidal particles, whose sizes are 5 micrometers or smaller, can easily pass through the filter 71*a*. Therefore, the solvent transferred into the inner space of the filter 74*a* contains a large number of colloidal particles dispersed in it. The inflow of the solvent increases the hydraulic pressure within the inner space of the filter, which forces the solvent to pass through the filter 74*a* from inside to outside. FIG. 6 conceptually shows the effect of the filter 74*a* on the solvent.

As shown on the left section of FIG. 6, each colloidal particle dispersed in the solvent is stabilized as a water particle surrounded by the silicone solvent. As described earlier, the activated carbon filter 74*a*1 was soaked with the silicone solvent beforehand, so that it is highly adsorptive to the silicone solvent. Therefore, when the colloidal particle attempts to pass through the activated carbon filter 74*a*1, the solvent will be removed from the surface of the colloidal particle due to the adsorbing effect. Thus, the solvent and water will be separated. The fine water particles deprived of the solvent coating will aggregate to form larger particles. In other words, the water will take the form of coarse particles and be large drops after passing through the activated filter 74*a*1. A coarse particle of water is hard to separate off the surface of the activated carbon filter 74*a*1 due to its surface tension. However, in the present case, the surface of the activated carbon filter 74*a*1 is enveloped with the non-woven fabric filter 74*a*2, from which water particles can easily separate. Therefore, after being adequately large, the water particles will separate off the surface of the non-woven fabric filter 74*a*2, then quickly settle and gather at the bottom of the liquid storage tank 70.

If the pre-filter unit 71 did not have the separation pipe 71*c*, the water particles produced by the coarse particle-making unit 74 as described previously could be drawn onto the filter 71*a* and entirely cover its surface. In the present embodiment, the separation pipe 71*c* restrains the water particles from being drawn and stuck onto the surface of the filter 71*a*.

The coarse particle-making unit 74 cannot separate all the fine colloid particles into water and the solvent; a portion of the fine colloid particles remains intact. However, since the pressure pump 73 is continuously running and the solvent in the upper layer of the liquid stored within the first chamber 70*c* is repeatedly drawn and passed through the pre-filter unit 71 and the coarse particle-making unit 74, the amount of the fine colloidal particles decreases every time they pass through these two units. Finally it will be nearly zero.

For example, in the present embodiment, the drawing/ejecting power of the pressure pump 73 is two liters per minute. In the drying and recovering operation, the amount of the liquid mixture flowing from the liquid mixture line 51 into the liquid storage tank 70 is four liters in 22 minutes of the drying and recovering operation; the average flow rate of the liquid mixture is 0.2 liters per minute. When the solvent obtained by distillation at the distiller 31 is treated, the amount of the solvent (liquid mixture) sent to the water separator 18 is 10 liters in 20 minutes; the average flow rate of the liquid mixture is 0.5 liters per minute. In any of these cases, the amount of the liquid mixture flowing into the liquid storage tank 70 is assuredly smaller than the power of the pressure pump 74. Therefore, even if a newly coming liquid mixture contains a large number of colloidal particles, it is possible to make the fine colloidal particles quickly turn into coarse particles and promptly settle by circulating the solvent by the pressure pump 73.

While the colloidal particles of water are being separated from the solvent, the solvent level within the first chamber 70*c* rises, and when it reaches the passage hole 70*b*, the solvent flows through the passage hole 70*b* into the second chamber 70*d*. Meanwhile, the water level within the main drainage pipe 54 also rises, and when it reaches the horizontal section 54*b*, the water is discharged to the outside. The air pipe 55 prevents the first drainage pipe 54 from being negatively pressured and working as a siphon after a predetermined amount of water is discharged through the horizontal section 54*b*. If the water level within the first drainage pipe 54 falls below the horizontal section 54*b* according to a decrease in the solvent level within the first chamber 70*c*, the flow of water through the first drainage pipe 54 immediately stops.

The passage hole 70*b* is located at a high level, whereas colloidal particles in the solvent are located at relatively low levels. Therefore, the colloidal particles, or water, are hard to flow into the second chamber 70*d*. Thus, practically, most of the water mixed in the solvent in the first chamber 70*c* will be removed; only a small portion of that water is allowed to flow into the second chamber 70*d* with the solvent. When the solvent is stored in the second chamber 70*d*, the solvent containing a small amount of water attempts to pass through the filter 75*a*. While the solvent passes through the fiber mesh of the filter 75*a*, the water is condensed on the fiber surface and forms large drops; this is due to the differences in surface tension and other properties between the solvent and the water. Then, due to their weight (or relative density difference from that of the solvent), the drops of water settle and gather at the bottom of the second chamber 70*d*.

With an increase in the solvent level within the second chamber 70*d*, the solvent level within the space surrounded by the filter 75*a* of the water separation unit 75 also increases. When the solvent level rises above the upper end port 60*a*, the solvent flows into the solvent recovery pipe 60 and is collected into the solvent tank 20.

Meanwhile, the water is collected at the bottom of the second chamber 70*d*. As explained earlier, the amount of water flowing into the second chamber 70*d* is inherently small. Therefore, the amount of water stored at its bottom is smaller than in the first chamber 70*c*, and the water-collecting rate is low. Accordingly, as opposed to the main drainage pipe 54 for letting the water spontaneously flow out according to the liquid level, the sub drainage pipe 76 returns the water to the circulation pipe 72: the electromagnetic valve 77 is opened only during the periods of time where the pressure pump 73 is running and closed during the other periods of time. When it is running, the pressure pump 73 not only makes the solvent flow through the circulation pipe 72 but also draws water from the bottom of the second chamber 70*d* through the sub drainage pipe 76. This water will be firstly stored at the bottom of the first chamber 70*c* and finally discharged to the outside.

As stated earlier, the amount of water collected at the bottom of the second chamber 70*d* is small. Accordingly, the inner diameter and other dimensions of the sub drainage pipe 76 are designed so that water passes through it at a considerably low flow rate. This design prevents the solvent in the second chamber 70*d* from being drawn. Of course, it is possible to give the sub drainage pipe 76 the same construction as the main drainage pipe 54.

As described thus far, a high-purity silicone solvent that scarcely contains water flows out from the solvent recovery pipe 60 and is collected into the solvent tank 20.

In the second embodiment, the solvent was subjected to the process of turning fine colloidal particles into coarse particles and removing them by the coarse particle-making unit 59, followed by the process of separating water by the water separation filter unit 75. However, it is possible to omit the water separation filter unit 75. The pre-filter unit 71 may be also omitted in some cases, e.g. if foreign matter can be removed from the solvent before it flows into the liquid storage tank. As the filter 74*a* of the coarse particle-making unit 74, any type of filter can be used in place of the activated carbon filter.

It should be noted that each of the first and second embodiments is merely an example of the present invention. It is clear that these embodiments can be changed or modified according to necessity within the spirit and scope of the present invention.

The invention claimed is:

1. A dry-cleaning machine comprising:

a drying tub for containing laundry that have been cleaned with a solvent;

an air passage for sending air into the drying tub and extracting the air from the drying tub;

a blower for producing an air current through the air passage in a predetermined direction;

a cooler, located in the air passage, for condensing vaporized solvent contained in the air emitted from the drying tub;

a heater, located in the air passage, for heating the air being sent into the drying tub; and a water separator for separating water from a liquid mixture composed of water and the solvent condensed by the cooler and for recovering the solvent, wherein the water separator includes a liquid storage tank for temporarily storing a liquid mixture extracted from the air passage, and an air relief section is located in a liquid mixture line for guiding the liquid mixture from the air passage to the liquid storage tank, wherein the outlet end of the liquid mixture line is immersed in the solvent located over the water due to a difference in relative density between the water and the solvent in the liquid mixture stored in the liquid storage tank, and wherein the water separator includes:

a solvent recovery pipe with a solvent outlet located at its upper end for extracting the solvent located over the water due to the difference in relative density between the water and the solvent in the liquid mixture stored in the liquid storage tank; and a drainage pipe having a vertical section, connected to the lower portion of the liquid storage tank, for guiding the water to a level higher than the connection point, and a bent section, which is located at a downstream position away from the vertical section and whose highest portion is located at a level equal to or lower than the solvent outlet of the solvent recovery pipe, and wherein the outlet end of the liquid mixture line is located at a level lower than a highest portion of the bent section of the drainage pipe.

2. The dry-cleaning machine according to claim 1, wherein the air relief section includes a filter for capturing the vaporized solvent when the air is exhausted from the liquid mixture line.

3. A dry-cleaning machine comprising:

a drying tub for containing laundry that have been cleaned with a solvent;

an air passage for sending air into the drying tub and extracting the air from the drying tub;

a blower for producing an air current through the air passage in a predetermined direction;

a cooler, located in the air passage, for condensing vaporized solvent contained in the air emitted from the drying tub;

a heater, located in the air passage, for heating the air being sent into the drying tub; and a water separator for separating water from a liquid mixture composed of water and the solvent condensed by the cooler and for recovering the solvent, wherein the water separator includes a liquid storage tank for temporarily storing a liquid mixture extracted from the air passage, and an air relief section is located in a liquid mixture line for guiding the liquid mixture from the air passage to the liquid storage tank, wherein the previous liquid storage tank is called the first liquid storage tank, and the water separator further includes:

a solvent collection pipe having a solvent outlet at its upper end for extracting a low-purity solvent located above the water due to a difference in relative density between the solvent and the water in the liquid mixture stored in the first liquid storage tank;

a first drainage pipe for discharging the water located under the solvent in the liquid mixture stored in the first liquid storage tank;

a second liquid storage tank for temporarily storing the low-purity solvent extracted through the solvent collection pipe;

a filter chamber forming a high-purity solvent storage section separated from the low-purity solvent by a solvent selection filter immersed in the low-purity solvent stored in the second liquid storage tank, the filter selectively allowing only the solvent to permeate through it from the low-purity solvent side;

a solvent recovery pipe for extracting a high-purity solvent from the high-purity solvent storage section; and a second drainage pipe for discharging the water located in the lower layer of the second liquid storage tank.

4. A dry-cleaning machine comprising:

a drying tub for containing laundry that have been cleaned with a solvent;

an air passage for sending air into the drying tub and extracting the air from the drying tub;

a blower for producing an air current through the air passage in a predetermined direction;

a cooler, located in the air passage, for condensing vaporized solvent contained in the air emitted from the drying tub;

a heater, located in the air passage, for heating the air being sent into the drying tub; and a water separator for separating water from a liquid mixture composed of water and the solvent condensed by the cooler and for recovering the solvent, where the water separator includes:

a first liquid storage tank for temporarily storing a liquid mixture extracted from the air passage;

a solvent collection pipe having a solvent outlet at its upper end for extracting a low-purity solvent located above the water due to the difference in relative density between the solvent and the water in the liquid mixture stored in the first liquid storage tank;

a first drainage pipe for discharging the water located under the solvent in the liquid mixture stored in the first liquid storage tank;

a second liquid storage tank for temporarily storing the low-purity solvent extracted through the solvent collection pipe;

a filter chamber forming a high-purity solvent storage section separated from the low-purity solvent by a solvent selection filter immersed in the low-purity solvent stored in the second liquid storage tank, the filter selectively allowing only the solvent to permeate through it from the low-purity solvent side;

a solvent recovery pipe for extracting a high-purity solvent from the high-purity solvent storage section; and a second drainage pipe for discharging the water located in the lower layer of the second liquid storage tank.

5. The dry-cleaning machine according to claim 3 or 4, wherein the solvent is a silicone solvent.

* * * * *